US006532038B1

(12) United States Patent
Haring et al.

(10) Patent No.: US 6,532,038 B1
(45) Date of Patent: Mar. 11, 2003

(54) RAIL CROSSING VIDEO RECORDER AND AUTOMATED GATE INSPECTION

(76) Inventors: Joseph Edward Haring, 542 Farmingdale Rd., Huntsville, AL (US) 35803; John Morgan Thorington, III, 1693 E. Stonehurst Dr., Huntsville, AL (US) 35801

( * ) Notice: Subject to any disclaimer, the term of this patent is extended or adjusted under 35 U.S.C. 154(b) by 0 days.

(21) Appl. No.: 09/374,308

(22) Filed: Aug. 16, 1999

(51) Int. Cl.[7] ..... H04N 7/18; H04N 9/47

(52) U.S. Cl. ..... 348/148; 348/149; 340/541; 701/301

(58) Field of Search ..... 340/351, 903; 348/148, 149, 143, 154, 155, 128; 375/240.26; 370/224; 701/301

(56) References Cited

U.S. PATENT DOCUMENTS

| | | | | | |
|---|---|---|---|---|---|
| 5,331,312 | A | * | 7/1994 | Kudoh | 340/541 |
| 5,825,412 | A | * | 10/1998 | Hobson | 348/149 |
| 6,034,944 | A | * | 3/2000 | Seki | 370/224 |
| 6,064,428 | A | * | 5/2000 | Trosino | 348/128 |
| 6,157,322 | A | * | 12/2000 | Anderson | 340/903 |
| 6,163,755 | A | * | 12/2000 | Peer | 701/301 |
| 6,226,329 | B1 | * | 5/2001 | Ishibashi | 375/240.26 |

* cited by examiner

*Primary Examiner*—Chris Kelley
*Assistant Examiner*—Charles Parsons
(74) *Attorney, Agent, or Firm*—Mark Clodfelter

(57) ABSTRACT

An invention is presented that expedites cause, fault and liability litigation of rail-highway crossing mishaps by providing a digital audio and video record of the events at the crossing as the locomotive or rail vehicle approaches and passes through the intersection. The electrical system components are located on and within the locomotive and can be powered exclusively by resources available from the locomotive. In addition, the invention may automatically and spontaneously inspect the operational status of the rail-highway crossing gate by capturing and processing the digital images of the gate by computational methods programmed in the locomotive's on-board computer. Alternatively, the images or video could be transmitted to a remote station for processing or inspection. If it is determined that the gate is malfunctioning, the computer may tag the digital image with relevant information from positioning equipment such as a Global Positioning Satellite (GPS) and may transmit the identified image via satellite or other communications network to the command station for further review. Since the locomotive can power the electrical components of the system, simple mechanical interrupt devices may be used to activate and deactivate the system. This system is effectively secure from sabotage, vandalism and environmental deterioration.

15 Claims, 6 Drawing Sheets

RAIL CROSSING VIDEO RECORDER AND AUTOMATED GATE INSPECTION

CROSS REFERENCE TO RELATED APPLICATIONS

Not Applicable.

STATEMENT

No federally sponsored research or development was used or is cited in the discovery of this invention.

REFERENCE TO MICROFICHE APPENDIX

Not applicable.

BACKGROUND OF THE INVENTION

The subject matter to which this invention pertains is in the field of video surveillance and remote automated inspection techniques. Railway crossing incidents will rise with projected increases in the use of railway transportation systems. The warning signals placed at rail-highway crossings are relied upon to warn the motorist of the right-of-way of an approaching locomotive. These warning signals may be configured as a gate or physical obstruction to the path of the motorist, a recognizable visual sign with a flashing colored light and bell, or merely an audible bell that sounds as the train approaches. The pilot of the locomotive is also required by statute to sound the horn as the train approaches the crossing. Intuitively, the safest and most effective way to warn the motorist of the crossing conditions is the lowering gate, thereby obstructing the path and causing the motorist to stop and heed the warning. Although it is the most effective, it is also the most expensive, both in construction and maintenance cost, thus limiting its usage to only the most hazardous of rail-highway intersections. As is the case with all mechanical systems, warning devices are prone to failure and therefore must be inspected periodically. The inspection schedule, as required by the Federal Railroad Administration (FRA), consists of a monthly field examination of a set of physical parameters measured on the warning signal. The cost of warning device inspections is graduated to the level of the complexity of the warning device, namely, the more complex the warning signal, the more intensive and therefore expensive the inspection. Although scheduled inspections may at times reveal incipient failure of the device, not all inspections can be or are performed perfectly and some impending signal failures can not be foreseen merely by periodic inspection.

The operating condition of the signal is based on predictive outcome. This is to say that if the signal is inspected and the measured parameters are within the specifications, it is predicted that the signal will continue to function properly until the next inspection. The invention presented herein provides a reliable, cost-effective alternative to the predictive inspection technique and will provide an expeditious visual means of determining cause and fault in case of crossing mishaps. On Mar. 15, 1999, Amtrak's City of New Orleans derailed after striking a steel-laden tractor-trailer in a rail-highway crossing near Bourbonnais, Ill., killing thirteen people. The tractor-trailer driver claimed that the crossing gates were not operating when he proceeded into the crossing. The railroad official claimed that the gates had been inspected as scheduled but could offer no proof as to whether the gates were operating at the time of the collision. The train pilot was too shaken to speak and the single witness to the crash could not properly communicate details of the crash to the investigators because the witness did not speak English. This invention would have been of significant value since the events at the crossing would have been recorded in real-time as the locomotive passed through the crossing.

Prevention of crossing accidents is another key element of this invention. By providing a means of spontaneously and automatically inspecting the rail-highway crossing signal without human interaction or assistance. The rail vehicle's on-board computer or a computer at a remote station connected wirelessly by an existing satellite network, can process the visual image of the crossing signal and a determination of the operational status of the signal can be made spontaneously.

BRIEF SUMMARY OF THE INVENTION

The objective of the present invention is to fulfill the need for an effective, inexpensive and secure method of inspecting rail-highway warning signals and providing an audible and visual record of the events that happen at the crossing as the locomotive approaches and passes through the crossing. The invention will substitute a spontaneous, automatic, real-time inspection technique in place of the predictive-based technique. This technique utilizes existing components to formulate a platform whereby digital image processing may be used to perform the inspection of rail-highway crossing gates every time a locomotive approaches and passes a crossing. Alternatively, human operators may view the images and video in order to investigate the operation of the equipment. This device will also allow timely determination of the cause and fault of a crossing mishap, reducing the amount of investigative resources expended at the wreck site.

DESCRIPTION OF THE VIEWS OF THE DRAWING

1) FIG. 1—Top view of railroad track and rail-highway crossing showing position of trip levers that could be used to activate and deactivate the video system. Bold arrow shows the direction of travel of the locomotive.

2) FIG. 2—Sample image or video captured by the side-mount cameras showing the gate with example bar code and gate functioning properly.

Figure 1:
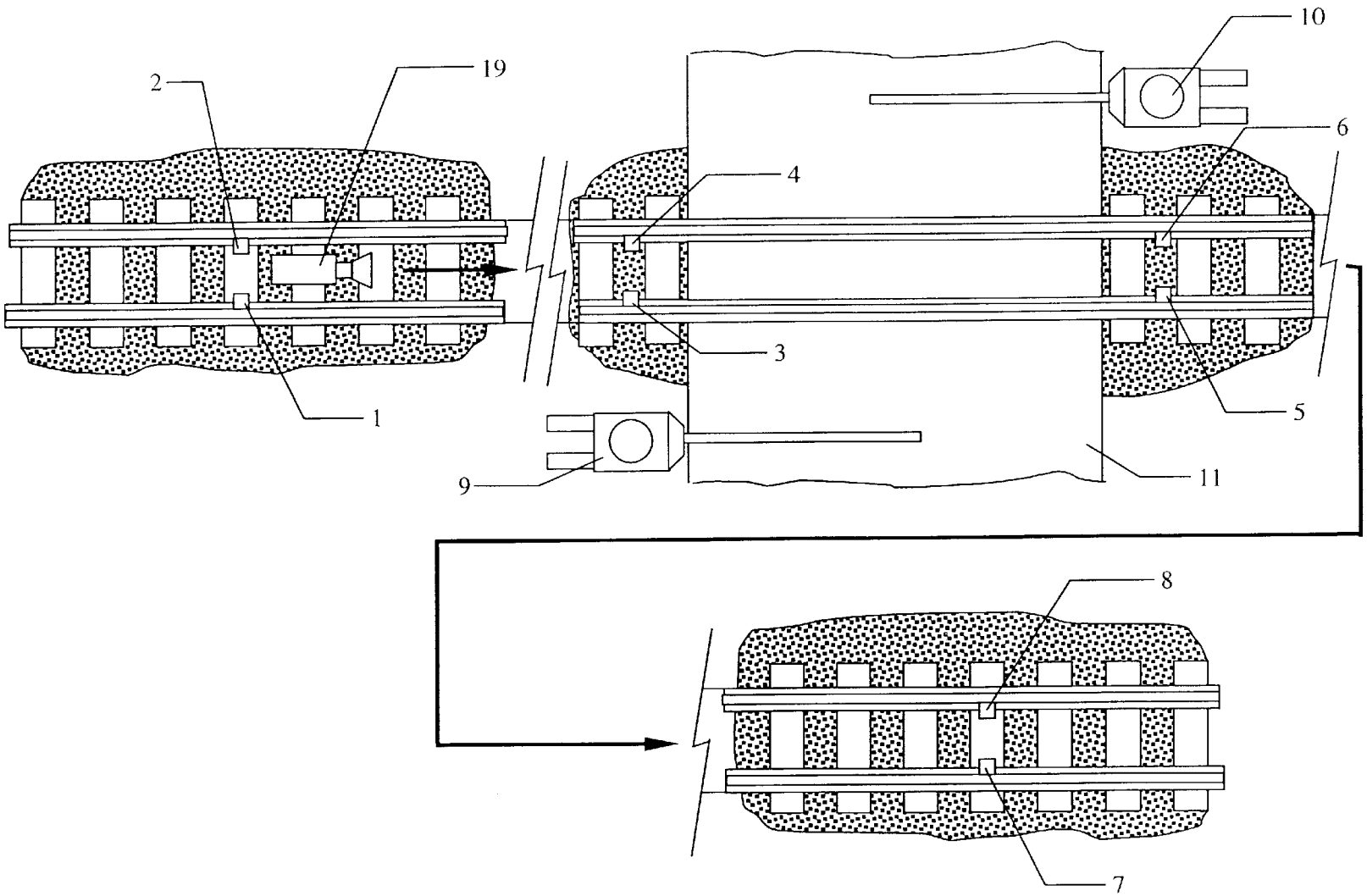
Figure 2:
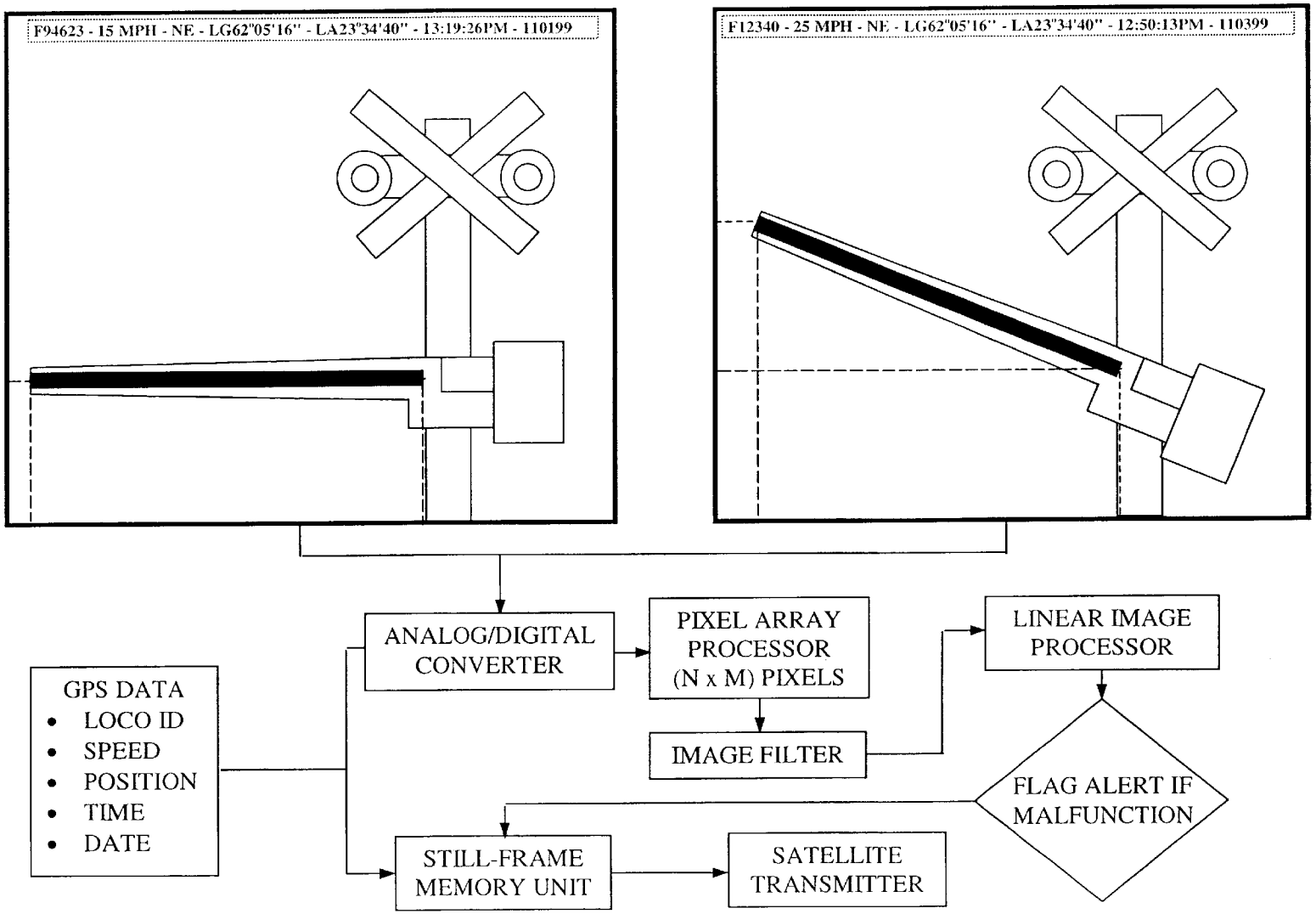
Figure 3:
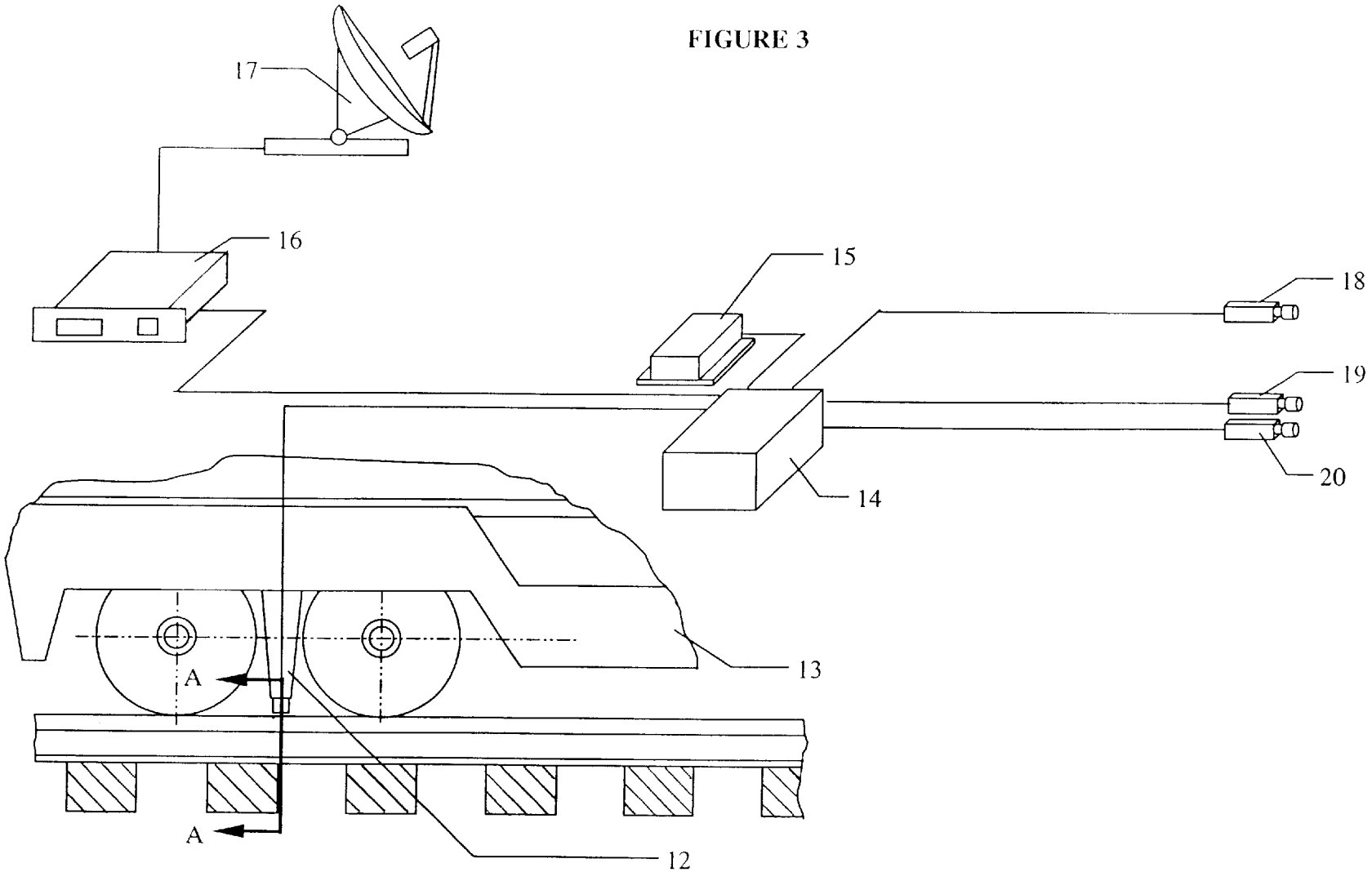

3) FIG. 3—Sample image or video captured by the side-mount cameras showing the gate with example bar code and gate malfunctioning.

Figure 4:
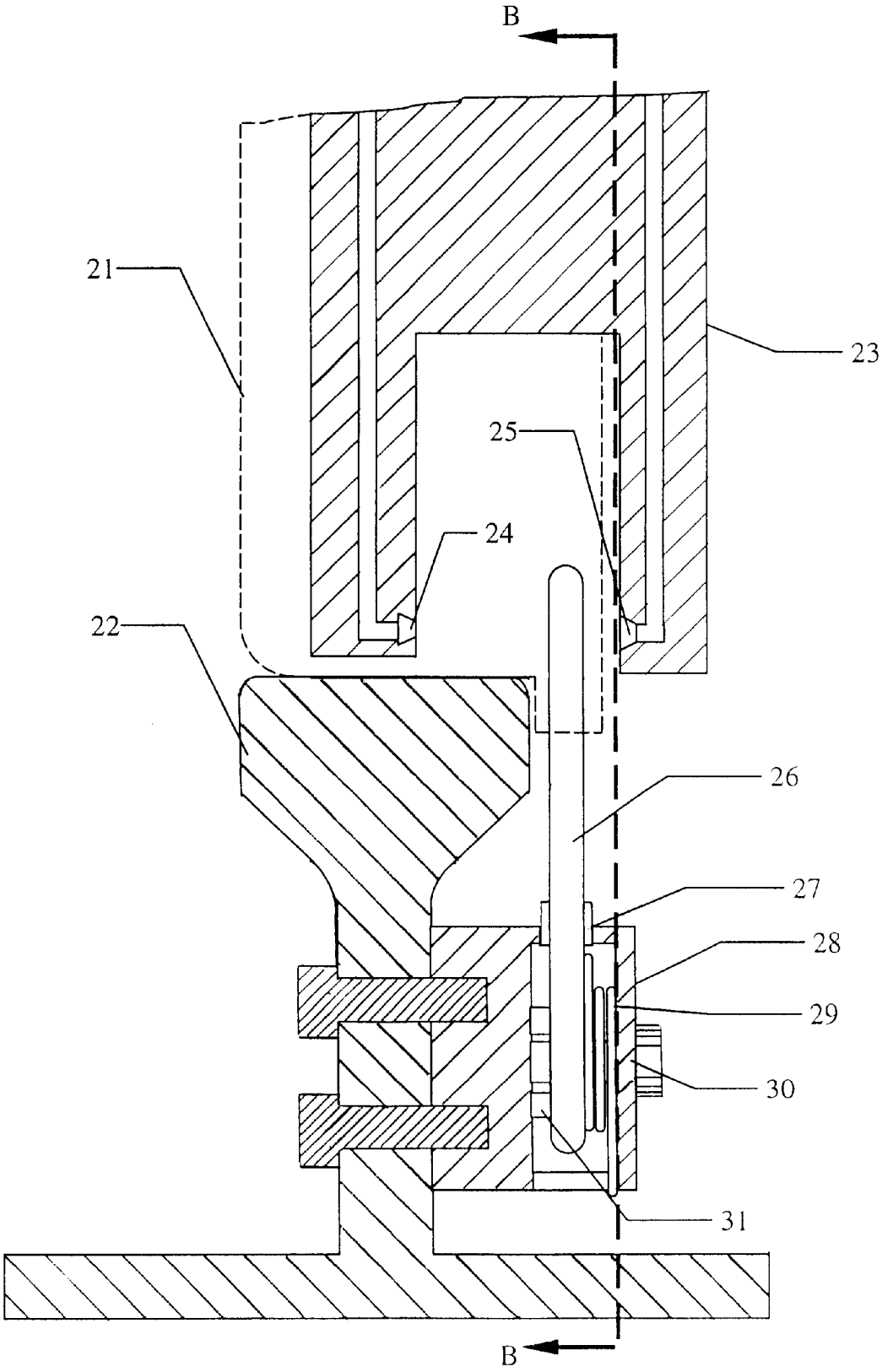

4) FIG. 4—Isometric view of the video system components that are located inside or on the locomotive.

Figure 5:
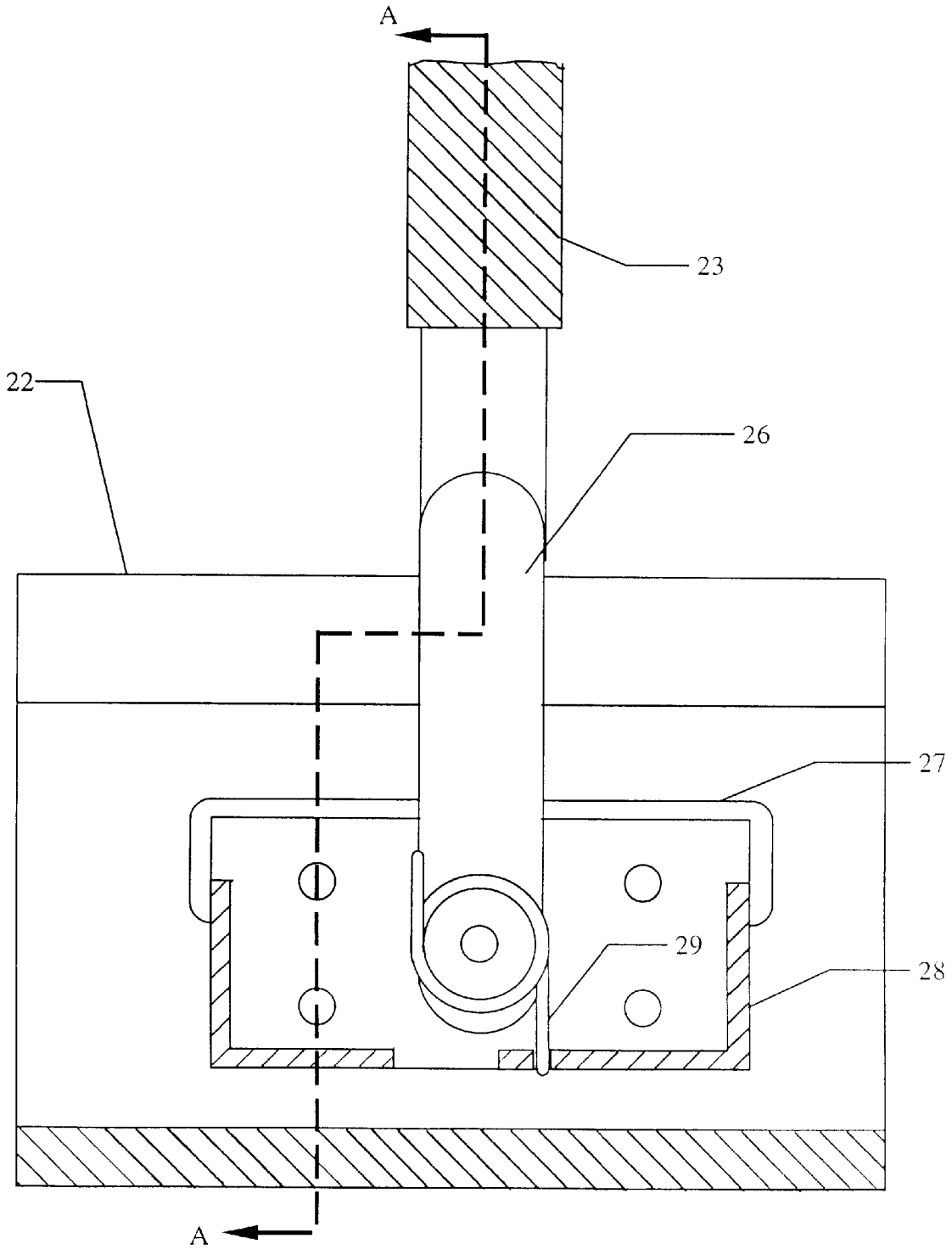

5) FIG. 5—Cross-section A—A from FIG. 4 showing details of the trip lever.

Figure 6:
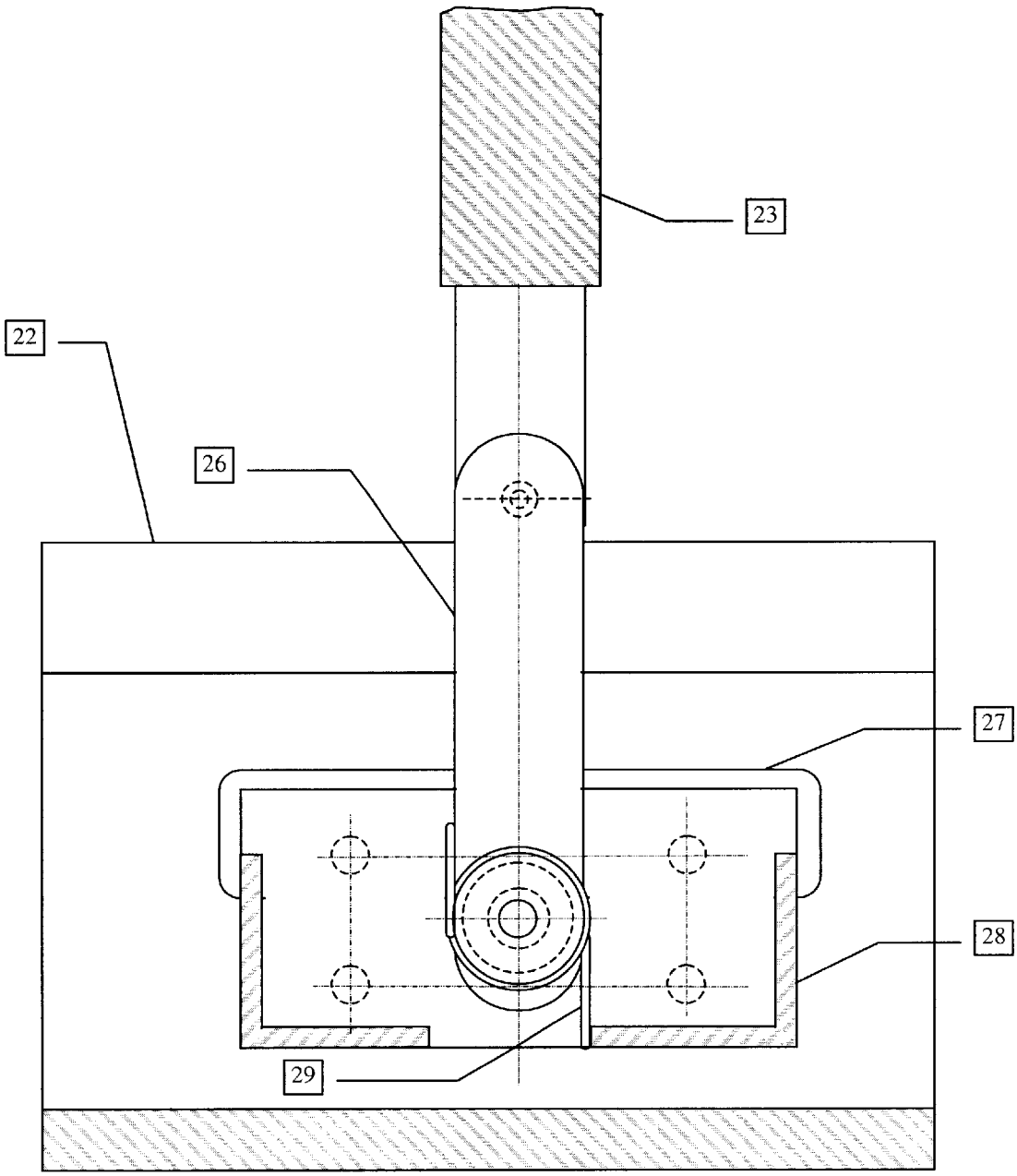

6) FIG. 6—Cross-section B—B from FIG. 5 showing details of the trip lever.

DETAILED DESCRIPTION OF THE INVENTION

Electrical power is supplied by resources on the locomotive to energize one or more of the following: a plurality of cameras [18,19,20], a digital computer [14], Global Positioning System (GPS) [16], digital memory unit [15] and any electrical switching device such as a light-emitting diode (LED) switch assembly [12], or any other type of switching device which can be energized exclusively by the locomotive. The on-board imaging or audio/video system may be activated at a predetermined distance from the rail-highway crossing as the locomotive approaches a rail-highway crossing [11]. The local interrupt device, which may be the LED trip device [1] described herein, is positioned on or near the rail and causes blockage of the light beam from the transmitting diode to the receiving diode. The blockage of the light beam causes an interruption of the electrical current in the switch and thus may signal the on-board computer [14] to commence storage of the audio/video stream from the camera and microphone [19] mounted on the front of the locomotive. The audio/video stream may be digitally processed by the computer [14] and stored as binary data on the electronic memory unit [15]. The audio/video stream is continuously recorded until power is terminated manually, or automatically by means such as but not limited to an accelerometer fuse or by the fourth interrupt device [7] located on the opposite side of the crossing.

As the locomotive enters the crossing, a second interrupt device, possibly positioned on or near the rail adjacent to the gate, may signal the computer [14], in the same manner as the first interrupt device [1], to capture a visual image of the crossing gate on the approach side of the highway. The rail-side of the gate [9] may display a directionally distinguishing symbol such as but not limited to a code that is a series or single black, white or reflective bar placed conspicuously on the gate that are directly in the line of view of the side still-image camera [20] and are rotationally fixed to the gate arm. This image may be processed by the on-board computer [14] or transmitted via satellite to a station, which may possibly use a picture element (pixel) processor capable of encoding the image as a simple array of binary colors. Computational filtering may be used to reduce the array to a monochromatic image representing the oriented symbol with a white or benign background. The slope or orientation of the image symbol can be computationally determined and subjected to tolerance parameters programmed into the computer. The angular orientation, with suitable tolerance, of the image determines the operational status of the gate. The image may be electronically tagged with information such as the relevant positional, time, date and speed data supplied by position and velocity sensing equipment such as a GPS [16]. The tagged digital image may be stored in the on-board memory unit and may also be digitally transmitted by communication means such a satellite antenna [17] to a base station for further review and distribution.

The video inspection technique may be applied to the gate [10] on the opposite side of the rail-highway crossing by possibly using an interrupt device [5] on the departing side of the highway crossing [11].

If the trip devices [1,2,3,4,5,6,7,8] are used as the interrupt devices, they could be installed on each rail at a distance from the rail-highway crossing, which is determined either by the visual ranges of the cameras or adjacent to the gates. Since the trip devices may be paired, locomotives approaching the rail-highway crossing from either direction will activate the video system. The interrupt device could be attached to the inside of the rail by four screws through the rail and into the lever chamber [28]. The dimension from the lever pivot to the lever reference line will be determined such that blockage of the light-emitting diode (LED) switch [23] is consistent for all locomotives equipped with the invention. The side of the rail [22] could be chosen as the appropriate placement of the switch mechanism since it will be cleared of obstacles such as snow, ice or mud by the preceding inner wheel flange [21] of the locomotive. As the LED switch passes over the lever reference point, the lever [26] blocks the light beam from the transmitting or powered side of the LED [24] to the receiving side [25]. The loss of continuous light uncouples the LED switch, which may signal the on-board computer [14] to initiate one or more of the following: the programmed sequences of recording video, capturing the images, transmitting the images or video, processing the inspection and terminating recording. The lever chamber [28] may feature an opening at the bottom to allow moisture and debris to fall out and an elastomeric boot seal [27] at the top to inhibit debris from entering the chamber [28]. The lever arm [26] may rotate about the lever pin [30] and may be augmented by a washer/bearing [31] between the inner surface of the chamber [28] and the arm [26].

One possible implementation of the LED switching device would allow the locomotive wheel as it approaches to contact the interrupt device lever arm[26] protruding from the inside of the rail. The arm [26] could rotate under the wheel [21] until contact with the wheel terminates as the wheel advances. A lever spring [29] could return the arm [26] to the vertical position whereby the LED switch structure [23] passes over the arm [26]. The arm [26], blocks the light beam from the LED transmitter [24], thereby signaling the computer [14] to begin the appropriate tasks. Multiple interrupt devices may be used to trigger different events such as initiating the capture of audio, video and image data, and the termination of said events.

We claim as our invention:

1. A system for performing inspections of railroad crossings wherein there exists at least one signaling device for warning automotive traffic of an approaching train, said system further comprising:

at least one sensing device mounted to a railroad vehicle for sensing said railroad vehicle approaching a said signaling device, at least one device mounted to said railroad vehicle for capturing an impression of at least signals from said signaling device, a recording device mounted to said railroad vehicle for recording at least said signals from said signaling device, a data processor mounted to said railroad vehicle and coupled to at least said sensing device and said recording device for controlling operation of said recording device responsive to at least said sensing device, a wireless transmitter associated with said signaling device, a sensor coupled to each said signaling device and providing a signal indicative of operation of an associated said signaling device, and each said sensor coupled to said wireless transmitter for transmitting each said signal, a receiver associated with said railroad vehicle for receiving each said signal from said wireless transmitter, said receiver coupled to said data processor, and, activation means coupled to said sensing device for activating said wireless transmitter as said railroad vehicle approaches said railroad crossing.

2. A system as set forth in claim 1 wherein said railroad vehicle is a locomotive.

3. A system as set forth in claim 1 wherein said device for capturing an impression includes at least one video camera positioned to capture a streaming image of said railroad crossing just prior to said railroad vehicle entering said railroad crossing.

4. A system as set forth in claim 3 wherein said device for capturing an impression includes at least one camera positioned to capture an image of said signaling device as said railroad vehicle is passing through said railroad crossing.

5. A system as set forth in claim 4 wherein said signaling device includes a barrier movable to block said automotive traffic during a train crossing, said data processor further comprising a program for optical determining whether said movable barrier has moved to block said automotive traffic.

6. A system as set forth in claim 5 further comprising indica located on said barrier for registering a position of said barrier with said camera and said data processor.

7. A. A system as set forth in claim 4 further comprising wireless transmission means for transmitting information relating to operation of said signaling device to a remote location.

8. A system as set forth in claim 1 wherein said sensing device further comprises:

a photo optical transmitter, a photo optical receiver, said photo optical transmitter and said photo optical receiver positioned near a wheel of said railroad vehicle and oriented such that there exists an optical path between said photo optical transmitter and said photo optical receiver, a light-blocking member mounted to a railroad track upon which said railroad vehicle is riding, said light-blocking member oriented so that said optical path is interrupted by said light-blocking member as said railroad vehicle passes thereover.

9. A system as set forth in claim 1 wherein said sensing device further comprises;

a global positioning sensor in said railroad vehicle and adapted to receive signals from global positioning satellites and accurately fix position of said railroad vehicle in coordinates of a global positioning format, memory storage registers in said railroad vehicle for storing, in coordinates of said global positioning format, position of all said railroad crossings along a route of said railroad vehicle, means for comparing position of said railroad vehicle with a position of a nearest one of said railroad crossings along said route, whereby when said railroad vehicle is at a selected distance from said nearest one of said railroad crossings then activating at least said storage device and recording an image of said signaling devices of said nearest one of said signal crossings as said railroad vehicle passes through said nearest one of said signal crossings.

10. A system as set forth in claim 9 further comprising at least one video camera positioned to capture streaming video of said one of said railroad crossing just prior to said railroad vehicle passing through said crossing.

11. A system as set forth in claim 9 further comprising wireless transmitter means for transmitting recorded data from said storage device to a remote location.

12. A system as set forth in claim 1 wherein said signaling device includes at least one light, said system further comprising means for detecting whether said light is illuminated as said railroad vehicle passes through said railroad crossing.

13. A system as set forth in claim 1 wherein said signaling device includes at least one audible warning, said system further comprising means for detecting whether said audible warning is operating as said railroad vehicle passes through said railroad crossing.

14. A system as set forth in claim 12 wherein said means for detecting whether said light is illuminated further comprises:

at least a wireless transmitter associated with said light for wirelessly transmitting data related to operation of said light to said railroad vehicle, and at least a wireless receiver associated with said railroad vehicle for receiving transmitted said data from said wireless transmitter, said receiver coupled to said data processor for recording said data.

15. A system as set forth in claim 13 wherein said means for detecting whether said audible warning is operating further comprises:

at least a wireless transmitter associated with said audible warning for wirelessly transmitting data related to operation of said audible warning to said railroad vehicle, and at least a wireless receiver associated with said railroad vehicle for receiving transmitted said data from said wireless transmitter, said receiver coupled to said data processor for recording said data.

* * * * *